US008360074B2

(12) United States Patent
Sutton

(10) Patent No.: US 8,360,074 B2
(45) Date of Patent: Jan. 29, 2013

(54) SMOKING ARTICLE

(75) Inventor: Joseph Peter Sutton, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/377,034

(22) PCT Filed: May 5, 2010

(86) PCT No.: PCT/EP2010/056091

§ 371 (c)(1), (2), (4) Date: Dec. 9, 2011

(87) PCT Pub. No.: WO2010/142498

PCT Pub. Date: Dec. 16, 2010

(65) Prior Publication Data

US 2012/0085359 A1 Apr. 12, 2012

(30) Foreign Application Priority Data

Jun. 12, 2009 (GB) ..... 0910198.1

(51) Int. Cl.
*A24D 3/06* (2006.01)

(52) U.S. Cl. ..... 131/346

(58) Field of Classification Search ..... None
See application file for complete search history.

(56) References Cited

U.S. PATENT DOCUMENTS 3,370,592 A 2/1968 Schultz et al.
4,015,610 A 4/1977 Pasche
4,185,645 A * 1/1980 Boegli et al. ..... 131/342
4,223,597 A 9/1980 Lebet
5,396,909 A 3/1995 Gentry et al.
2002/0153017 A1 10/2002 Georgitsis et al.

FOREIGN PATENT DOCUMENTS

EP 1972213 A1 9/2008
LU 52346 A1 1/1967
WO 2004/068975 A1 8/2004
WO 2009/106374 A1 9/2009

OTHER PUBLICATIONS

Search Report dated Jan. 27, 2010, for UK application No. GB0910198.1, filed Jun. 12, 2009.

International Search Report and Written Opinion, mailed Jul. 29, 2010, for PCT International Application No. PCT/EP2010/056091, filed May 5, 2010.

* cited by examiner

*Primary Examiner* — Michael J Felton
(74) *Attorney, Agent, or Firm* — Cooley LLP

(57) ABSTRACT

A smoking article (10) comprises a rod (12) of smokeable material and a filter (14) attached to one end of the rod. The filter comprises an elongate body of filter material (16) wrapped with a transparent plug wrap (18). A first tipping wrapper (20*a*) overlies the join between the rod and the filter to attach the filter to the rod. At least one additional tipping wrapper (20*b*) is provided around the filter, spaced from and separate to the first tipping wrapper such that a portion of the transparent plug wrap is exposed between the first and at least one additional tipping wrapper to define a window portion (22) through which the filter material is visible. A method of producing such a smoking article is also disclosed.

18 Claims, 5 Drawing Sheets

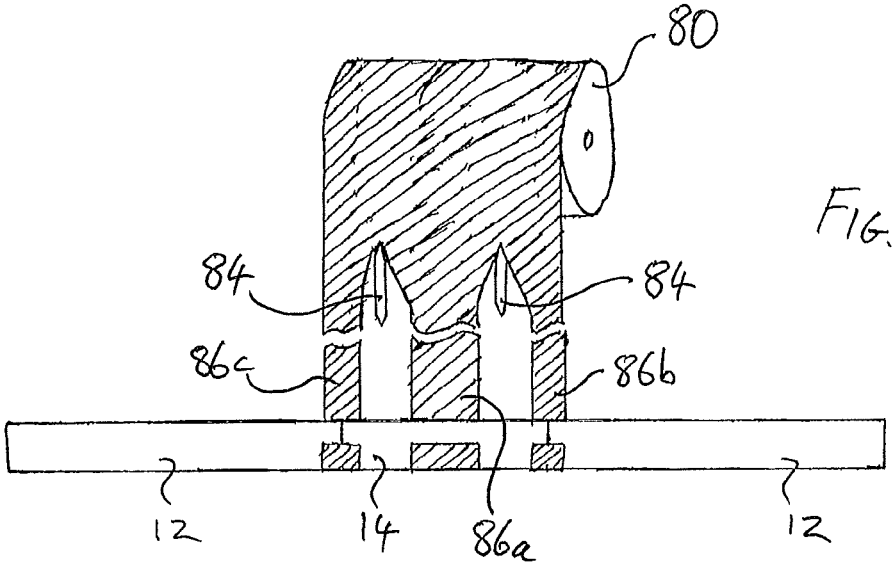
FIG. 8a
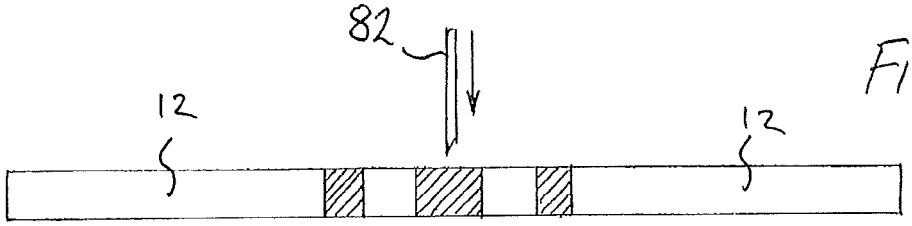
FIG. 8b
FIG. 8c
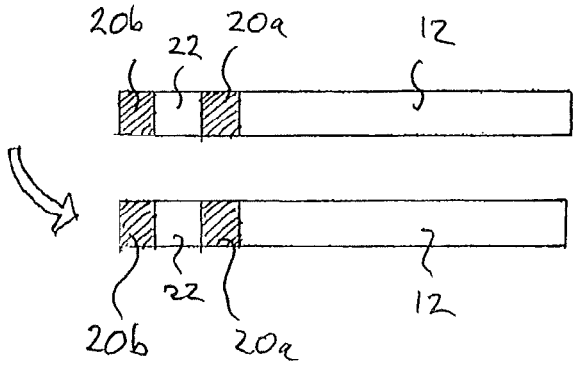

SMOKING ARTICLE

CLAIM FOR PRIORITY

This application is a National Stage Entry entitled to and hereby claims priority under 35 U.S.C. §§365 and 371 to corresponding PCT Application No. PCT/EP2010/056091, filed May 5, 2010, which in turn claims priority to British Application Serial No. GB 0910198.1, filed Jun. 12, 2009. The entire contents of the aforementioned applications are herein expressly incorporated by reference.

The present invention relates to a smoking article having a filter and, more particularly, to a smoking article having a filter with a window portion therein, and a method of producing the same.

Conventionally, smoking articles such as cigarettes comprise a tobacco rod in the form of a cylinder of tobacco or tobacco-based smokeable material wrapped in a paper wrapper, which may be provided with a filter unit. In its basic form, the filter unit is a cylindrical element formed from filtration material such as acetate tow, optionally including features to modify the smoke flow and filter function, such as recesses and gaps, and additives such as particulate carbon. The tow may be wrapped in a layer of plug wrap which helps maintain the cylindrical shape and structure of the filtration material. The filter unit is joined to the tobacco rod using a tipping paper, which is an outer paper layer wrapped around the filter unit and overlapping the join between the filter unit and tobacco rod. The tipping paper is glued in place.

Various forms of smoking articles including filters are known, for example, WO 2004/068975 describes a smoking article having a filter wherein the filter comprises a pair of discrete plugs of filter material wrapped with a transparent plug wrap and, a tipping paper attaching a tobacco rod to the filter. The tipping wrapper is formed from discrete sections of opaque paper disposed either side of a discrete section of transparent material, which are bonded together to form the tipping wrapper. The filter of this known smoking article thereby includes a window formed by the transparent material to allow the a space between the filter segments to be visible.

However, the above prior art filter suffers the disadvantage that the complex construction of the tipping paper formed from discrete sections of material bonded together, means that manufacture is more complicated and time consuming, and thereby costly.

A further known smoking article is disclosed in US 2002/0153017 and comprises a tobacco rod having a filter attached to one end thereof. The filter comprises a plurality of plugs of filter material wrapped with a transparent plug wrap. The filter is attached to the tobacco rod with a tipping wrapper, which may include one or more windows formed therein to enable the filter material to be visible. However, this prior art suffers the disadvantage that the tipping wrapper must be provided with pre-formed holes for the windows, or else, an additional manufacturing step is required to form discrete holes in the tipping wrapper prior to it being applied to the smoking article. In either case, the tipping wrapper construction is complex and/or the manufacturing process is complex, thereby increasing manufacturing costs.

Accordingly, the present invention seeks to provide a smoking article having a filter which substantially alleviates or overcomes the problems mentioned above.

The present invention provides a smoking article comprising a rod of smokeable material and, a filter attached to one end of the rod, said filter comprising an elongate body of filter material wrapped with a transparent plug wrap, wherein a first tipping wrapper overlies the join between the rod and the filter to attach the filter to the rod, and at least one additional tipping wrapper is provided around the filter, spaced from and separate to the first tipping wrapper such that a portion of the transparent plug wrap is exposed between the first and at least one additional tipping wrapper to define a window portion through which the filter material is visible.

Two additional tipping wrappers may be wrapped around the filter spaced from and separate to the first tipping wrapper and each other, such that a portion of the transparent plug wrap is exposed between each tipping wrapper to define two discrete window portions through which the filter material is visible.

The body of filter material may comprise a plurality of filter sections wrapped in said transparent plug wrap and at least one of the filter sections may have differing filtering characteristics to the or each other filter section(s).

Two of the filter sections may be spaced from each other to define a cavity therebetween in the filter.

At least one of the filter sections may be wrapped in its own inner plug wrap underneath said transparent plug wrap and the at least one inner plug wrap may also be transparent.

At least one thread may extend at least partially through the filter and the at least one thread may be disposed adjacent the transparent plug wrap and be visible through the window portion.

The present invention also provides a method of manufacturing a smoking article comprising providing a filter formed of an elongate body of filter material wrapped with a transparent plug wrap, attaching a rod of smokeable material to one end of the filter by wrapping a first tipping wrapper around the filter and the rod such that it overlies the join between the filter and the rod and, wrapping at least one additional tipping wrapper around the filter, spaced from and separate to the first tipping wrapper, such that a portion of the transparent plug wrap is exposed between the first and at least one additional tipping wrapper to define a window portion through which the filter material is visible.

The step of wrapping the first tipping wrapper around the filter and rod and the step of wrapping the at least one additional tipping wrapper around the filter, may be performed simultaneously.

The method may comprise feeding the first tipping wrapper and the at least one additional tipping wrapper from separate reels of tipping wrapper material. The method may also comprise cutting each tipping wrapper to length as they are fed from their respective reels.

Alternatively, the method may comprise feeding a single band of tipping wrapper material from a single reel to at least one cutting element and cutting the single band of tipping wrapper material as it passes the at least one cutting element to form the first tipping wrapper and the at least one additional tipping wrapper. The method may also comprise cutting each tipping wrapper to length after they have passed the cutting element(s).

The method may comprise applying glue to the tipping wrappers prior to wrapping around the filter/rod to attach the tipping wrappers to the filter and/or rod.

The method may further comprise attaching a second rod of smokeable material to the other end of the filter by wrapping another tipping wrapper around the other end of the filter and the second rod such that it overlies the join between the other end of the filter and the second rod, said another tipping wrapper being spaced from and separate to said at least one additional tipping wrapper, such that a portion of the transparent plug wrap is exposed between said another tipping wrapper and said at least one additional tipping wrapper to define a window portion through which the filter material is visible, and cutting the filter at its middle point to create two separate smoking articles.

The method may comprising initially wrapping an elongate body of filter material with a transparent plug wrap to form said filter.

In order that the invention may be more fully understand, embodiments of the invention will be described, by way of example only, with reference to the accompanying drawings, in which.

Figure 1:
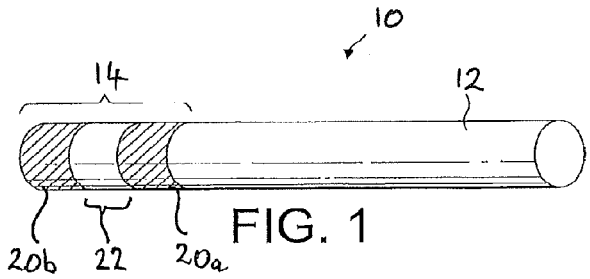
FIG. 1 shows a perspective view of a smoking article according to a first embodiment of the invention.
Figure 2:
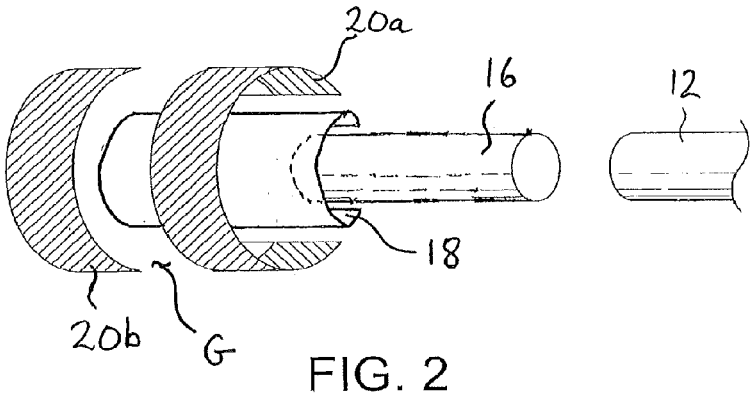
FIG. 2 shows an exploded perspective view of the smoking article of FIG. 1.
Figure 7A:
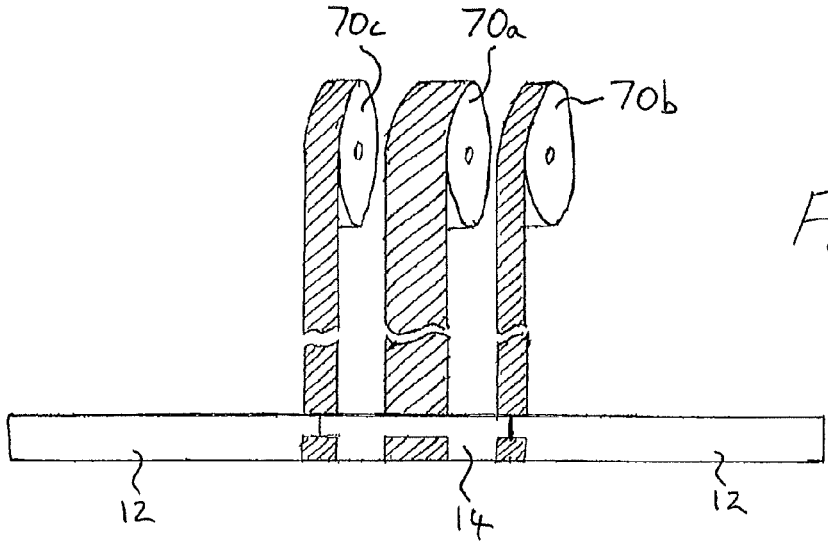
Figure 7B:
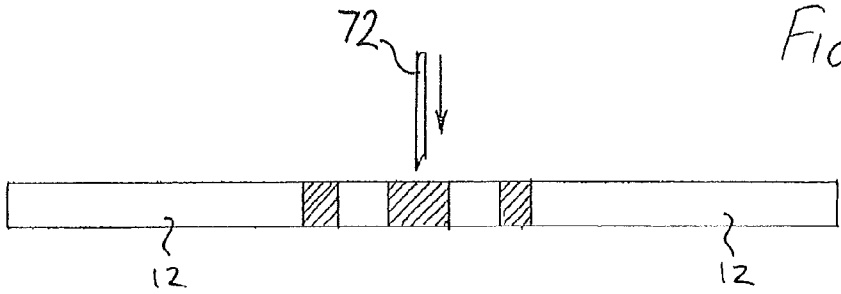
Figure 7C:
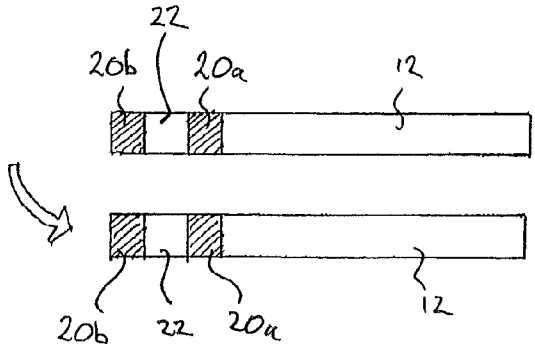

FIGS. 7*a* to 7*c* schematically show steps of a first manufacturing process according to the invention to produce a smoking article as shown in FIGS. 1 and 2; and FIGS. 8*a* to 8*c* schematically show steps of a second, alternative manufacturing process according to the invention to produce a smoking article as shown in FIGS. 1 and 2.

Referring now to FIGS. 1 and 2, a smoking article 10 according to a first embodiment of the invention is shown comprising a tobacco rod 12 and a filter 14. The tobacco rod 12 comprises a cylinder of smokeable tobacco or tobacco-based material contained within a paper sleeve.

The filter 14 comprises a cylindrical plug of filter material 16 such as cellulose acetate tow, wrapped with a plug wrap 18 which serves to contain the loose filter material in the cylindrical form of the filter. The plug wrap 18 is made of a transparent material such that the filter material 16 is visible through the plug wrap 18. The term 'transparent used herein is intended to refer to any material which is fully or partially see-through. This is, for instance, regardless of colour, so that clear, tinted, or otherwise 'translucent' materials are deemed to be 'transparent'.

The filter 14 is attached to the tobacco rod 12 by a first tipping wrapper 20*a* which is wrapped around the tobacco rod 12 and the filter 14 and overlies the join therebetween. The tipping wrapper includes an adhesive to bond it to the filter 14 and tobacco rod 12.

A second, separate tipping wrapper 20*b* is wrapped around the mouth end of the filter 14 distal to the tobacco rod 12 end of the filter 14, and is spaced from the first tipping wrapper 20*a* to leave a gap G therebetween. The transparent plug wrap 18 is exposed in the gap G to define a window portion 22 in the filter section of the smoking article 10. The filter material 16 is thereby visible though the window 22. Furthermore, the above-described smoking article 12 having the window 22 in the filter section is simply and cheaply produced without use of a complex tipping-wrapper configuration having punched holes or separate pre-bonded sections, or a complex tipping wrapper manufacturing stage.

Figure 3:
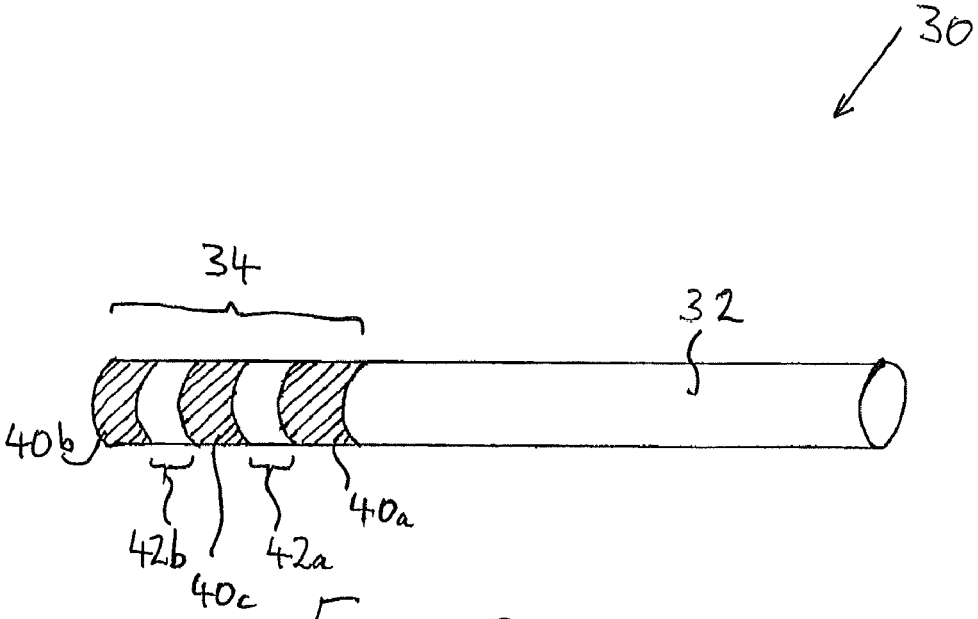
FIG. 3 shows a perspective view of a smoking article according to a second embodiment of the invention.
Figure 4:
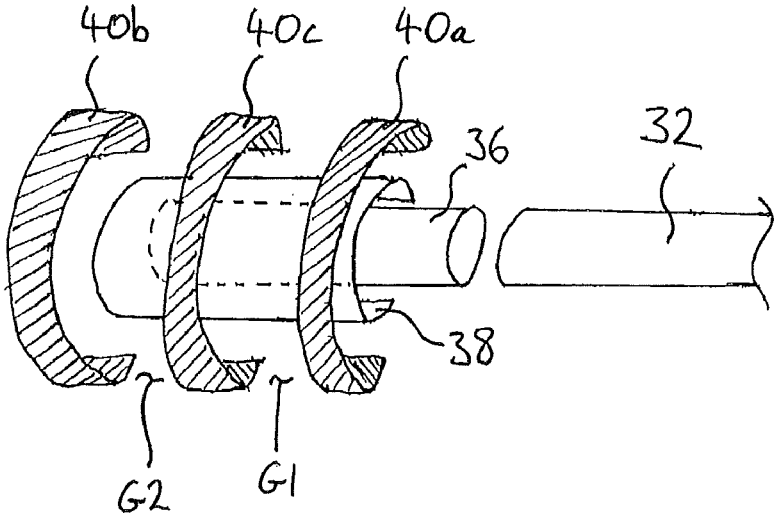
FIG. 4 shows an exploded perspective view of the smoking article of FIG. 3.

A smoking article 30 of a second embodiment of the invention is shown in FIGS. 3 and 4, and comprises a tobacco rod 32 and a filter 34. The tobacco rod 32 comprises a cylinder of smokeable tobacco or tobacco-based material contained within a paper sleeve.

As with the smoking article 12 of the first embodiment described above, the filter 34 comprises a cylindrical plug of filter material 36 such as cellulose acetate wrapped with a plug wrap 38 which serves to contain the loose filter material in the cylindrical form of the filter. The plug wrap 38 is made of a transparent material such that the filter material 36 is visible through the plug wrap 38.

The filter 34 is attached to the tobacco rod 32 by a first tipping wrapper 40*a* which is wrapped around the tobacco rod 32 and the filter 34 and overlies the join therebetween, and includes an adhesive to bond it to the filter 34 and tobacco rod 32.

A second, separate tipping wrapper 40*b* is wrapped around the mouth end of the filter 34 distal to the tobacco rod 32 end of the filter 34, and is spaced from the first tipping wrapper 40*a*. However, the smoking article 30 of the second embodiment differs from the smoking article 10 of the first embodiment, in that a third tipping wrapper 40*c* is wrapped around the filter 34 between and spaced from the first and second tipping wrappers 40*a*, 40*b*. Thereby, a first gap G1 is left between the first tipping wrapper 40*a* and the third tipping wrapper 40*c*, and a second gap G2 is left between the third tipping wrapper 40*c* and the second tipping wrapper 40*b*.

The transparent plug wrap 18 is exposed in the gaps G1, G2 to define a pair of window portions 42*a*, 42*b* in the filter section of the smoking article 32. The filter material 36 is thus visible though the two windows 42.

Figure 5:
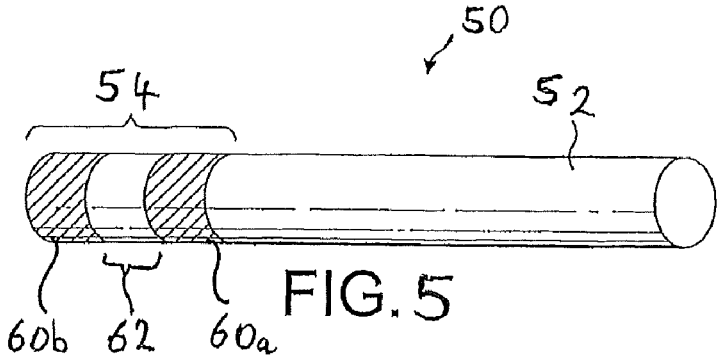
FIG. 5 shows a perspective view of a smoking article according to a third embodiment of the invention.
Figure 6:
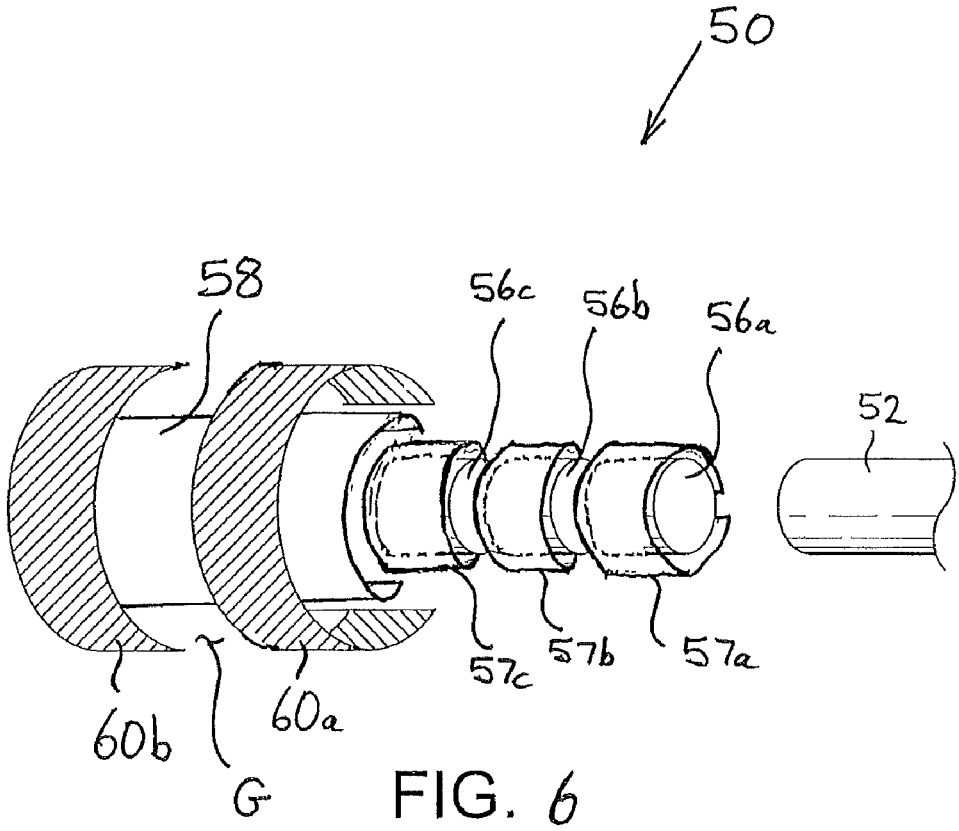
FIG. 6 shows an exploded perspective view of a smoking article FIG. 5.

A smoking article 50 of a third embodiment of the present invention is shown in FIGS. 5 and 6 and comprises a tobacco rod 52 and a filter 54. The tobacco rod 52 comprises a cylinder of smokeable tobacco or tobacco-based material contained within a paper sleeve.

The smoking article 50 of the third embodiment of the invention differs from smoking articles 10, 30 of the first and second embodiments, in that the filter 54 does not comprise a single elongate plug of filter material, but instead, comprises three separate filter sections of cylindrical plugs of filter material 56*a*, 56*b*, 56*c*. Each individual plug of filter material 56*a*, 56*b*, 56*c* may be the same, such as cellulose acetate, or each may differ from the others, for example, one may be cellulose acetate impregnated with activated charcoal particles. The individual plugs of filter material 56*a*, 56*b*, 56*c* may also be of different colours. In order that each individual plug of filter material 56*a*, 56*b*, 56*c* can be kept in its desired cylindrical form during the manufacturing process, each is wrapped in an individual plug wrap 57*a*, 57*b*, 57*c*.

Once collated together side by side, the three individually wrapped plugs of filter material 56*a*, 56*b*, 56*c* are then wrapped together with an single outer plug wrap 58 which holds them together as one unit. The outer plug wrap 58 is made of a transparent material such that the individual wrapped cylindrical filter plugs 56*a*, 56*b*, 56*c* are visible through the outer plug wrap 58.

In order that the filter material 56*a*, 56*b*, 56*c* of each individual plug can be visible through the outer plug wrap 58, one or more of the individual plug wraps 57*a*, 57*b*, 57*c* may also be made from a transparent material.

As with the previously-described embodiments, the filter 54 is attached to the tobacco rod 52 by a first tipping wrapper 60*a* which includes an adhesive on one side and is wrapped around the tobacco rod 52 and the filter 54 and overlies the join therebetween.

A second, separate tipping wrapper 60*b* is wrapped around the mouth end of the filter 54 distal to the tobacco rod 52, and is spaced from the first tipping wrapper 60*a* to leave a gap G therebetween. The transparent outer plug wrap 58 is exposed in the gap G to define a window portion 62 in the filter section of the smoking article 52. The individual plug wraps 57*a*, 57*b*, 57*c* wrapped around the individual plugs of filter material

56*a*, 56*b*, 56*c* are therefore visible though the window 62. Furthermore, if the individual plug wraps 57*a*, 57*b*, 57*c* which are visible though the window 62 are also of a transparent material, then the individual plugs of filter material 56*a*, 56*b*, 56*c* are therefore visible though the window 62.

In the third embodiment of the invention described above, the filter 54 is described as comprising three separate plugs of filter material 56*a*, 56*b*, 56*c*. However, it will be appreciated that two or more than three may be provided within the scope of the invention. Furthermore, the invention is not intended to be limited to each individual plug of filter material 56*a*, 56*b*, 56*c* being first wrapped in its own individual plug wrap 57*a*, 57*b*, 57*c*, and instead, the outer plug wrap 58 may serve to hold all three plugs of filter material together and in the cylindrical form The first and second tipping wrappers 60*a*, 60*b* may be sized and aligned to expose only the middle cylindrical plug of filter material 56*b* in the window 62. Alternatively, the first and second tipping wrappers 60*a*, 60*b* may be arranged to expose parts of the first and third cylindrical plugs of filter material 56*a*, 56*c* in the window 62. In a further alternative of the third embodiment, the middle plug could be omitted to create a cavity within the filter 54 which would be visible through the window 62. The cavity could be an empty air-filled space, or could be filled with some further smoke modification material, for example, an adsorbent such as carbon granules, or a flavourant such as loose mint leaf. Yet further, the filter could include one or more threads extending therethrough, and such thread(s) could be visible in the cavity through the window 62.

Variations are possible from the above described smoking articles 10, 30, 50 within the scope of the invention. For example, more than three separate tipping wrappers may be provided circumscribing the filter and/or tobacco rod and spaced from each other, thereby providing more than two separate window portions. The filter may comprise various filter materials, such as paper or other cellulose acetate-based materials, in addition to or in place of cellulose acetate. Furthermore, the filter material may include additional additives such as particulate activated charcoal to aid filtration properties. The filter material 16/36/56 may also include one or more grooves formed around its outer edge and visible through the transparent plug wrap 18/38/58, and thereby visible through the window 22/42*a,b*/62. The filter material 16/36/56 may also include one or more threads of, for example, cotton or cellulose acetate, formed around its outer edge and visible through the transparent plug wrap 18/38/58, and thereby visible through the window 22/42*a,b*/62. Such thread(s) may extend partially or fully though the length of the filter. It will thus be appreciated that the smoking article comprising the window portions in the embodiments described and any variations thereof are clearly visually distinctive from conventional smoking articles.

A first method of manufacturing the a smoking article according to the first embodiment of the invention will now be described with reference to FIGS. 6*a* to 6*c*. In FIG. 6*a*, two tobacco rods 12 are aligned with a double length filter 14 between them and in abutment with each other. (The process of producing and cutting to length of the tobacco rods 12 is as known in the art, and so a detailed description of this process will not be described). The double length filter 14 comprises a cylindrical plug of filter material wrapped with a transparent plug wrap. Three separate reels of tipping wrapper paper are provided, a first central reel 70*a*, and two outer reels 70*b*, 70*c*, one either side of the central reel 70*a*. The central reel 70*a* is approximately twice the width of the two outer reels 70*b*, 70*c*, but is not as wide as the double length filter 14 is long.

The central reel 70*a* of tipping wrapper is fed out and is wrapped around the middle of the double length filter 14, and the two outer reels 70*b*, 70*c* of tipping wrapper are fed out and one is wrapped around each end of the double length filter 14 and around the adjacent end of the respective tobacco rod 12, to overlie the join therebetween and secure the respective tobacco rod 12 to the respective end of the double length filter 14. The tipping wrappers are then cut from their respective reels 70*a*, 70*b*, 70*c* resulting in a double-length smoking article as shown in FIG. 6*b*.

A cutter 72 cuts the double length smoking article at the middle of the double length filter 14, to produce two separate smoking articles 10, as shown in FIG. 6*c*, and shown and described previously with respect to FIGS. 1 and 2. It will thus be appreciated that the first tipping wrapper 20*a* of the resulting smoking article 10 is provided by the tipping wrapper from one of the outer tipping wrapper reels 70*b*, 70*c*, and the second tipping wrapper 20*b* at the mouth end of the resulting smoking article 10 is provided by the tipping wrapper from the central tipping wrapper reel 70*a* after the cutter 72 separates the two smoking articles 10.

It will be apparent from the above that the method of producing the smoking article 10 having a window portion 22 in the filter section 14 is much simplified over known prior art processes and so manufacturing costs are greatly reduced. The size of the window portion 22 in the resulting smoking article can be determined by selection of tipping wrapper paper reel widths and spacing of the tipping wrapper reels from each other.

A second, alternative method of manufacturing a smoking article 10 according to the first embodiment of the invention will now be described with reference to FIGS. 7*a* to 7*c*. In FIG. 7*a*, as with the first method described above, two tobacco rods 12 are aligned with a double length filter 14 between them and in abutment with each other. The double length filter 14 comprises a cylindrical plug of filter material 16 wrapped with a transparent plug wrap 18. The alternative method differs from the first method described previously in that instead of there being three separate reels of tipping wrapper paper 70*a*, 70*b*, 70*c*, there is only single wide reel of tipping wrapper paper 80. However, a pair of cutting blades 84 (which may be blades, cutting wheels, or any other suitable cutting elements) are disposed between the wide reel of tipping paper 80 and the filter 14/tobacco rods 12. As the tipping paper is fed from the wide reel 80 towards the filter 14/tobacco rods 12, it passes over the cutting blades 84 and is thereby cut into three separate bands of tipping wrapper, a central tipping wrapper band 86*a*, and two outer tipping wrapper bands 86*b*, 86*c*.

The central tipping wrapper band 86*a* is fed to be wrapped around the middle of the double length filter 14, and the two outer tipping wrapper bands 86*b*, 86*c* are fed so that one is wrapped around each end of the double length filter 14 and around the adjacent end of the respective tobacco rod 12, to overlie the join therebetween and secure the respective tobacco rod 12 to the respective end of the double length filter 14. The three tipping wrapper bands 86*a*, 86*b*, 86*c* are then cut from the rest of the bands, resulting in a double-length smoking article as shown in FIG. 7*b*.

As with the first method described previously, a cutter 82 then cuts the double length smoking article at the middle of the double length filter 14, to produce two separate smoking articles 10, as shown in FIG. 7*c*, and shown and described previously with respect to FIGS. 1 and 2. It will thus be appreciated that the first tipping wrapper 20*a* of the resulting smoking article 10 is provided by one of the outer tipping wrapper bands 86*b*, 86*c* and the second tipping wrapper 20*b* at the mouth end of the filter 14 of the resulting smoking article 10 is provided by the central tipping wrapper band 86*a* after the cutter 82 separates the two smoking articles 10.

It will be apparent from the above that the alternative method of producing the smoking article 10 having a window portion 22 in the filter section 14 is also much simplified over known prior art processes and so manufacturing costs are greatly reduced. The size and position of the window portion 22 in the resulting smoking article can be determined by selection of tipping wrapper paper reel 80 width, the position of the two cutting blades 84 relative to the tipping wrapper reel 80 and the position that the three bands of tipping wrappers 86*a*, 86*b*, 86*c* are fed to.

In order to manufacture a smoking article 30 according to a second embodiment of the invention using the first method described above, there could be five separate reels of tipping wrapper, a central wider reel and two narrower reels each side of the central reel. The central reel would provide tipping wrapper around the middle of the double length filter, the outermost two reels would provide tipping wrappers around and overlying the join between the double length filter and the respective tobacco rod, and the remaining two tipping wrapper reels between the central reel and the outermost reels would provide a tipping wrapper around the double length filter between the central tipping wrapper and the outer tipping wrappers. Thereby, when the cutter 72 cuts the double smoking article in the middle, it would produce two smoking articles 30 as shown in FIG. 3.

In order to manufacture a smoking article 30 according to a second embodiment of the invention using the second, alternative method described above, there could be four cutting blades instead of just two, such that the single wide reel of tipping wrapper paper is then cut into five bands, a central wider band, and two narrower bands on each side of the central band. The central band of tipping wrapper would be provided around the middle of the double length filter, the outermost two bands of tipping wrapper would be provided around and overlying the join between the double length filter and the respective tobacco rod, and the remaining two bands of tipping wrapper between the central band and the outermost bands would be wrapped around the double length filter between the central tipping wrapper band and the outer tipping wrapper bands. Thereby, when the cutter 82 cuts the double smoking article in the middle, it would produce two smoking articles 30 as shown in FIG. 3.

In order to manufacture a smoking article 50 according to a third embodiment of the invention using either of the above described methods, it would simply be necessary to provide an alternative filter unit comprising a plurality of separate filter plugs, wrapped in the outer transparent plug wrap, in place of the single double length filter. From that point onwards, the manufacturing processes would be the same as described above.

Furthermore, the variations of the two methods described above (i.e. having more than three separate tipping wrapper reels, or more than two cutters to produce more than three separate tipping wrapper bands) could be implemented to provide a plurality of windows in the multi-section filter portion of the smoking article, as opposed to just the one window as illustrated in FIG. 1.

In order that the tipping wrappers adhere to the filter and tobacco rods, they are provided with glue prior to being wrapped around the filter/tobacco rod. The glue may be pre-applied to the tipping wrapper material during manufacture thereof, or alternatively, may be applied at a point between the tipping wrapper material being fed from the or each reel, and being wrapped around the filter/tobacco rods.

Although the above-described methods comprise forming two smoking articles at a time by attaching tobacco rods to opposite ends of a double length filter and cutting the filter in the middle, it will be appreciated that the invention is not limited to such a method and the smoking articles may alternatively be produced individually by a single filter being attached to a single tobacco rod by a first tipping wrapper and then one or more tipping wrappers being wrapped around the filter, separate to and spaced from the first tipping wrapper.

In the above described embodiments, the tipping wrappers comprise bands of paper, such that the tactile sensation for the smoker corresponds to the feeling of regular paper-tipped smoking articles. In particular, it is therefore advantageous for the tipping wrapper at the mouth-end of the filter to be made from paper.

The plug-wraps are described in the above embodiments as being made from a transparent material. Such materials may include, but are not limited to, one of polypropylene, polyvinyl chloride (PVC), cellulose acetate film, polyethylene terephthalate (PET), polyethylene oxide (PEOX), polyethylene, cellophane, Natureflex™ or polyactic acid (PLA). In addition to the plug wrap being totally transparent and clear, it could also be coloured transparent ('translucent'), or include further patterns, markings, logos or other graphics or indicia printed thereon.

Although various embodiments of the smoking article and manufacturing method of the present invention have been described above, the scope of the invention is not intended to be limited to these examples and any combination of non-mutually exclusive features described above is also intended to fall within the scope of the invention, defined by the claims hereafter.

The invention claimed is:

1. A smoking article comprising a rod of smokeable material and, a filter attached to one end of the rod, said filter comprising an elongate body of filter material wrapped with a transparent plug wrap, wherein a first tipping wrapper overlies the join between the rod and the filter to attach the filter to the rod, and at least one additional tipping wrapper is provided around the filter, spaced from and separate to the first tipping wrapper such that a portion of the transparent plug wrap is exposed between the first and at least one additional tipping wrapper to define a window portion through which the filter material is visible.

2. The smoking article according to claim 1 wherein two additional tipping wrappers are wrapped around the filter spaced from and separate to the first tipping wrapper and each other, such that a portion of the transparent plug wrap is exposed between each tipping wrapper to define two discrete window portions through which the filter material is visible.

3. The smoking article according to claim 1 wherein the body of filter material comprises a plurality of filter sections wrapped in said transparent plug wrap.

4. The smoking article according to claim 3 wherein at least one of the filter sections has differing filtering characteristics to the at least one other filter sections.

5. The smoking article according to claim 3 wherein two of the filter sections are spaced from each other to define a cavity therebetween in the filter.

6. The smoking article according to claim 3 wherein at least one of the filter sections is wrapped in its own inner plug wrap underneath said transparent plug wrap.

7. The smoking article according to claim 6 wherein the at least one inner plug wrap is also transparent.

8. The smoking article according to claim 1 comprising at least one thread extending at least partially through the filter.

9. The smoking article according to claim 8 wherein the at least one thread is disposed adjacent the transparent plug wrap and is visible through the window portion.

10. A method of manufacturing a smoking article comprising:

providing a filter formed of an elongate body of filter material wrapped with a transparent plug wrap;

attaching a rod of smokeable material to one end of the filter by wrapping a first tipping wrapper around the filter and the rod such that it overlies the join between the filter and the rod; and wrapping at least one additional tipping wrapper around the filter, spaced from and separate to the first tipping wrapper, such that a portion of the transparent plug wrap is exposed between the first and at least one additional tipping wrapper to define a window portion through which the filter material is visible.

11. The method according to claim 10 wherein wrapping the first tipping wrapper around the filter and rod and wrapping the at least one additional tipping wrapper around the filter are performed simultaneously.

12. The method according to claim 10 further comprising feeding the first tipping wrapper and the at least one additional tipping wrapper from separate reels of tipping wrapper material.

13. The method according to claim 12 further comprising cutting each tipping wrapper to length as they are fed from their respective reels.

14. The method according to claim 10 further comprising feeding a single band of tipping wrapper material from a single reel to at least one cutting element and cutting the single band of tipping wrapper material as it passes the at least one cutting element to form the first tipping wrapper and the at least one additional tipping paper.

15. The method according to claim 14 comprising cutting each tipping wrapper to length after they have passed the at least one cutting element.

16. The method according to claim 12 comprising applying glue to the first tipping wrapper prior to wrapping around the filter and the rod to attach the tipping wrappers to the filter and the rod and applying glue to the at least one additional tipping wrapper prior to wrapping around the filter to attach the at least one additional tipping wrapper to the filter.

17. The method according to claim 10 further comprising attaching a second rod of smokeable material to the other end of the filter by wrapping another tipping wrapper around the other end of the filter and the second rod such that it overlies the join between the other end of the filter and the second rod, said another tipping wrapper being spaced from and separate to said at least one additional tipping wrapper, such that a portion of the transparent plug wrap is exposed between said another tipping wrapper and said at least one additional tipping wrapper to define a second window portion through which the filter material is visible, and cutting the filter at its middle point to create two separate smoking articles.

18. The method according to claim 10 comprising initially wrapping the elongate body of filter material with the transparent plug wrap to form said filter.

* * * * *